US005199270A

United States Patent [19]

Simkens

[11] Patent Number: 5,199,270

[45] Date of Patent: Apr. 6, 1993

[54] PROCESS AND DEVICE FOR MAKING ICE CUBES

[76] Inventor: Marcellus C. P. L. Simkens, Hoogweg 24, Wingene, Belgium, 8050

[21] Appl. No.: 807,874

[22] PCT Filed: Jul. 6, 1990

[86] PCT No.: PCT/BE90/00040

§ 371 Date: Jan. 21, 1992

§ 102(e) Date: Jan. 21, 1992

[87] PCT Pub. No.: WO91/01472

PCT Pub. Date: Feb. 7, 1991

[30] Foreign Application Priority Data

Jul. 21, 1989 [GB] United Kingdom ..... 8916712

[51] Int. Cl.[5] ..... F25C 5/08

[52] U.S. Cl. ..... 62/73; 62/138; 62/353

[58] Field of Search ..... 62/73, 138, 352, 353

[56] References Cited

U.S. PATENT DOCUMENTS

| | | | |
|---|---|---|---|
| 2,718,125 | 9/1955 | Horvay | 62/351 |
| 3,027,731 | 4/1962 | Lindenberg et al. | 62/138 |
| 3,418,823 | 12/1968 | Vivai | 62/138 |
| 4,199,956 | 4/1980 | Lunde | 62/138 |
| 4,207,750 | 6/1980 | Simkens | 62/138 |

FOREIGN PATENT DOCUMENTS

| | | | |
|---|---|---|---|
| 892262 | 6/1982 | Belgium | 62/138 |
| 227611 | 7/1987 | European Pat. Off. | 62/138 |

*Primary Examiner*—William E. Tapolcai

*Attorney, Agent, or Firm*—Oblon, Spivak, McClelland, Maier & Neustadt

[57] ABSTRACT

The device contains a frame, a refrigeration mechanism with an evaporator, a mechanism to slightly defrost the ice formed around the protruding parts and to cause it to fall off, a water tank that is movably mounted on the frame, a water supply pipe which is located above the tank, a mechanism for moving the tank from an uppermost position around the above-mentioned protruding parts to a lowest position and vice versa, a mechanism for controlling the refrigeration mechanism and control the mechanism for moving the tank, and an upper grid that is hingedly mounted on the frame, is pushed up by the movement of the tank from its lowest to its uppermost position and protrudes before the uppermost position of the tank on the top in such a manner between the downward directed protruding parts of the evaporator that, when ice cubes are formed around these protruding parts already situated above all these ice cubes and cannot go down as long as all ice cubes have not fallen off, while the mechanism which controls the refrigeration mechanism and the mechanism for moving the tank have at least one switch which is controlled by the upper grid in such a manner that the mechanism to slightly defrost the ice formed around the protruding parts to cause the ice to fall off, are only switched off and the refrigeration mechanism only cools the protruding parts again when the upper grid is rotated downwards from its uppermost position.

14 Claims, 8 Drawing Sheets

PROCESS AND DEVICE FOR MAKING ICE CUBES

TECHNICAL FIELD

Figure 1:
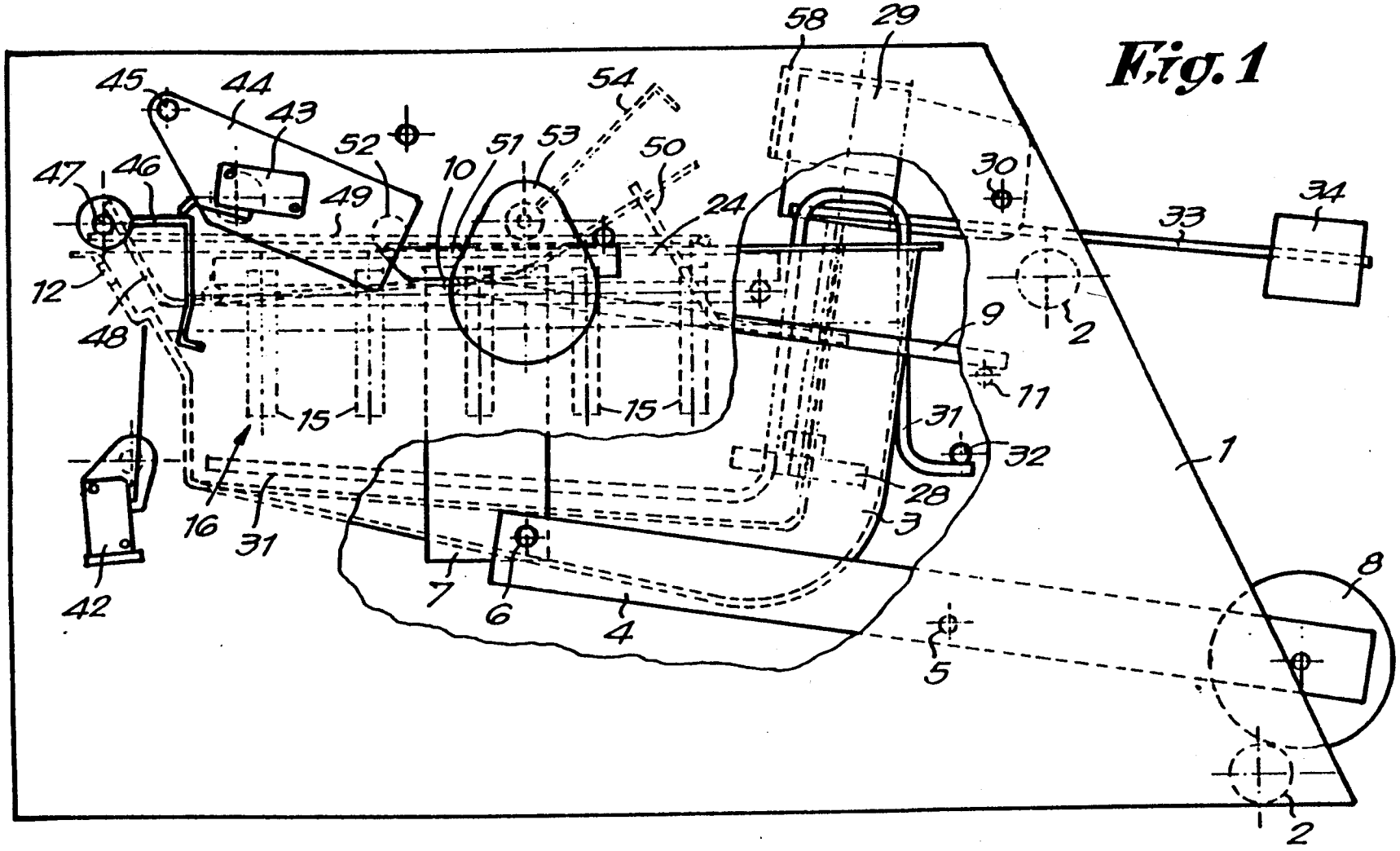

The invention relates to a process for making ice cubes, comprising moving a tank with water into an uppermost position around downward directed protruding parts, refrigerating the protruding parts, when the tank is in said uppermost position so that ice is formed around said protruding parts, moving said tank from its uppermost position to a lowermost position by supplying water to it, after sufficient ice has been formed around said protruding parts and, slightly or partially defrosting the ice around said protruding parts so that said ice falls off, after sufficient ice has been formed around said protruding parts.

BACKGROUND ART

A process of this type is described in BE-A-892 262 of Feb. 25, 1982 of the applicant. In this known process an agitator is found in the water tank, in its highest position. When this agitator experiences resistance from the ice that is formed in the tank, the motor of an agitator device will rotate in relation to the frame and this motor thereby turns an electrical switch which is part of organs which control the refrigeration mechanism and the aforementioned means.

The turning of this microswitch has as a consequence that means for opening and closing the water supply pipe open this pipe. Through the water supplied, the tank becomes heavy enough to move from its uppermost position to its lowest position. But before this tank has reached its lowest position, the protruding parts are heated by heating fluid so that the ice cubes come free from these protruding parts. The refrigeration mechanism no longer cools the protruding parts in the meantime.

The filled tank, in its lowest position, allows water to flow away through an opening. After sufficient water has flowed away through the opening, the tank with its contents will have become sufficiently light to rotate upwards again. During this upward movement the defrosting is terminated and cooling fluid is again sent through the evaporator. But before the tank has reached its uppermost position a small amount of water is again allowed into the tank, however, not sufficient to prevent the upward movement of the tank.

This known process is indeed very simple but still presents the risk that during the defrosting one or more ice cubes remain hanging on the protruding parts. Through the deposit of scale on the protruding parts they can become rough through which this risk increases. During the following cycle, when the tank is again situated at the top, and cooling occurs again the agitator in the tank will very quickly be slowed down by the cube that has remained hanging, even before sufficient ice is formed around the protruding parts. Cooling will therefore be stopped too early and the defrosting start too quickly. Larger and smaller ice cubes are obtained and through the decreased cooling cycle and therefore the frequent defrosting periods the production of ice is reduced.

The invention has the purpose of remedying these disadvantages and to provide a process for making ice cubes of the above mentioned type whereby the ice cubes have almost the same size and the reduction of the production of ice as a result of ice cubes which remain hanging on the protruding parts is avoided, regardless of the manner in which the thickness of the ice formed and therefore the stopping of the cooling and starting of the defrosting is determined.

For this purpose an upper grid hingedly mounted around a horizontal axis is pushed up, by the movement of the tank from said lowermost position to said uppermost position, into an uppermost position in which position it is located between the protruding parts so that, when the ice is formed around said parts the grid is retained by said ice and cannot go down as long a all ice has not fallen off, and in that the defrosting is only stopped and subsequently the refrigerating of the protruding parts restarted after said grid has hinged downwards from its uppermost position and thus after all the ice has fallen off.

The control that all ice cubes have fallen off is effected in a very simple mechanical manner. As long as all ice cubes have not fallen off, the new cycle for making ice cubes cannot start again and the defrosting continues. The duration of the defrosting can therefore be determined by the ice cubes falling off and therefore in a very simple and certain manner.

In a process for making ice cubes, the use of a feeler which detects whether an ice cube has fallen off the protruding parts of an evaporator is in itself already known from U.S. Pat. No. 3,418,823. In this known process the feeler is however in the shape of a finger which only controls one single ice cube and obviously does not offer the desired security that all ice cubes have fallen off. The ice cube is indeed controlled from which it is assumed that the latter will fall by roughening the protrusion around which this cube is formed but after a lapse of time the roughness of the other protrusion can become equally great, so that another cube may still remain hanging longer.

In an advantageous embodiment of the invention the water supplied for moving the tank from the uppermost position to its lowermost position is at the same time used for slightly defrosting the ice formed around said protruding parts.

Because absolute security is achieved as long as defrosting occurs until all ice formed around the protuding parts has fallen off and as long as this has not been effected the cycle cannot continue further, defrosting with cold water can be effected without problems and namely with the cold water that must be supplied to fill the water tank.

In the above mentioned known process warm gas is used for the defrosting, the temperature of which is controlled by a thermostat.

The invention also relates to an apparatus specifically designed for carrying out the above mentioned process.

The invention thus also relates to a device for making ice cubes which contains a frame, a refrigeration mechanism which in turn has a compressor, a condenser, an expansion element and an evaporator with downward directed protruding parts permanently mounted on this frame, means to slightly defrost the iced formed around the protruding parts and to cause it to fall off, a water tank that is movably mounted on the frame, a water supply pipe which exits above the tank, means to move the tank from an uppermost position around the above mentioned protruding parts to a lowest position and vice versa, which means comprise themselves to open and close the water supply pipe, and organs which controls the aforementioned refrigeration mechanism and the above mentioned means, characterized in that it contains an upper grid that is hingedly mounted around a horizontal axis to the frame and extends in the uppermost position of the tank on the top just between the downward directed protruding parts of the evaporator so that, when the ice cubes have been formed around these protruding parts it is situated above the ice cubes and cannot go down as long as all ice cubes have not fallen off, while the organs which control the refrigeration mechanism and the above mentioned means have at least one switch which is controlled by the upper grid.

In a particular embodiment of the invention the evaporator is of the type that has a number of fingers directed downwards of which the uppermost extremities, on the one hand, are mounted between two parts of the refrigeration pipe of the evaporator, and, on the other hand, are situated above these parts in a defrosting liquid supply.

In another particular embodiment of the invention the device has a storage tray for ice cubes which is situated under the water tank and a feeler grid that is mounted on top of the storage tray, while the organs which control the refrigeration mechanism and the above mentioned means have a switch which is controlled by this feeler grid to switch off at least the means for moving the tank when sufficient ice is present in the storage tray.

Figure 2:
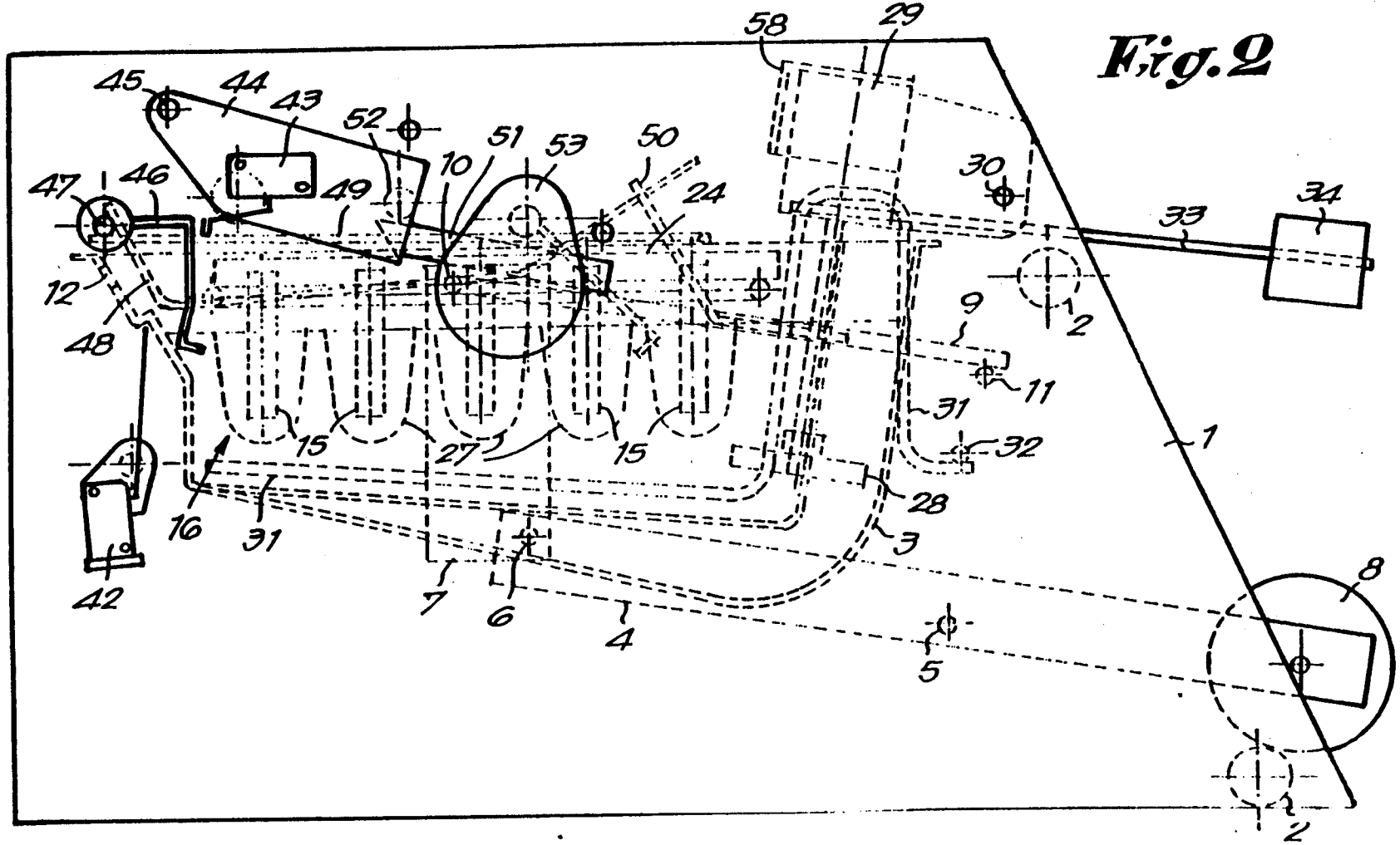
Figure 3:
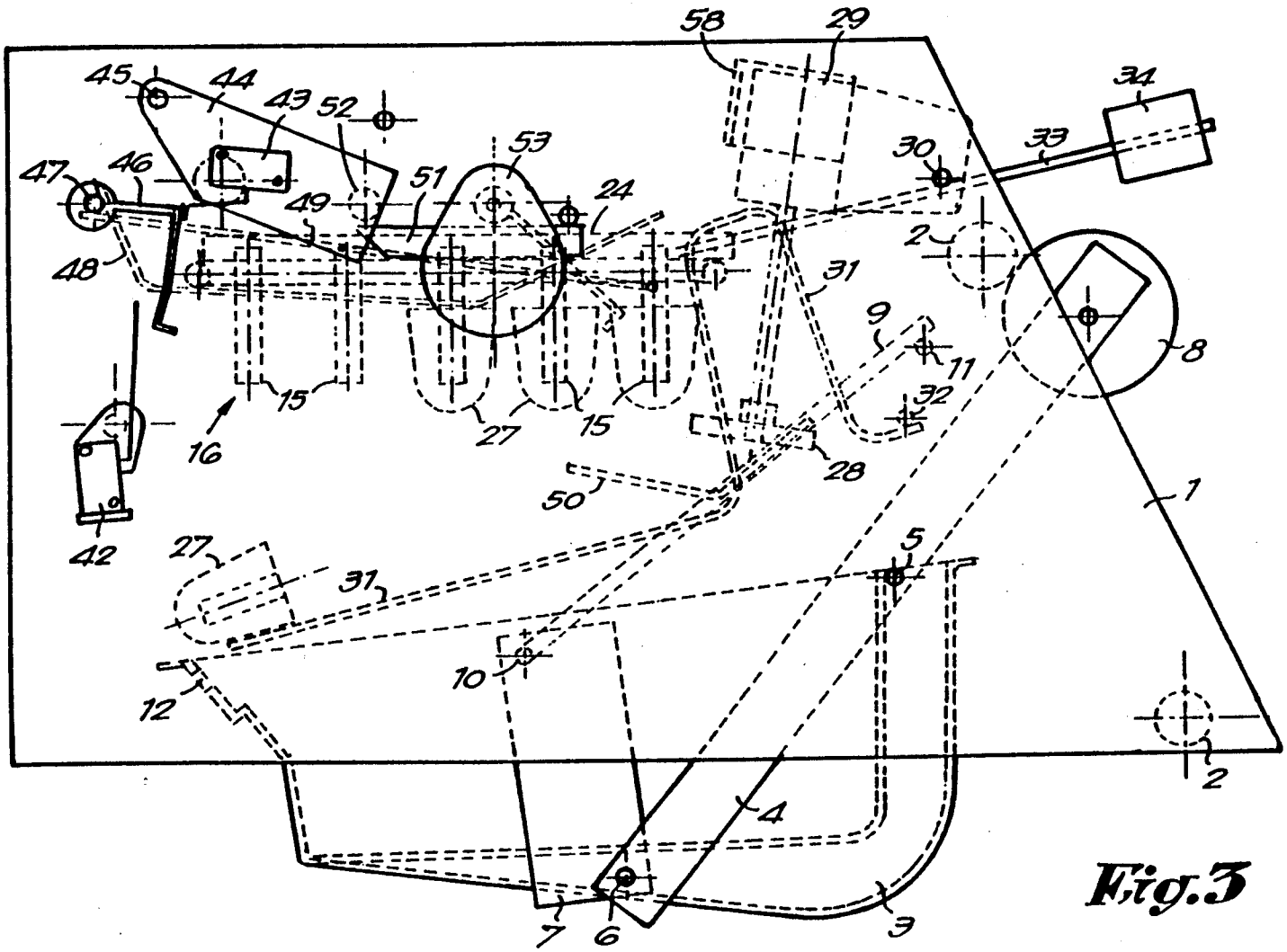
Figure 4:
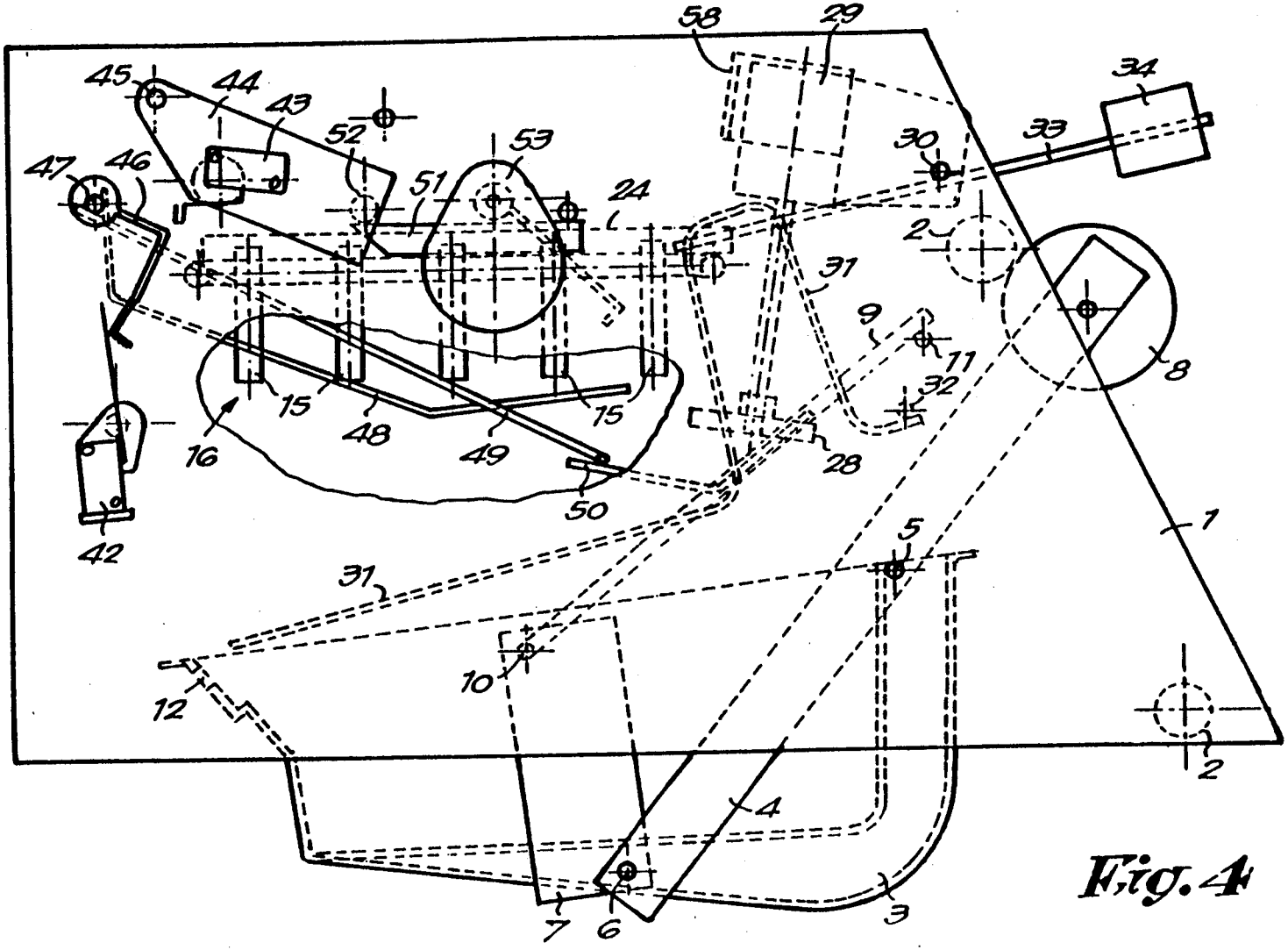
Figure 5:
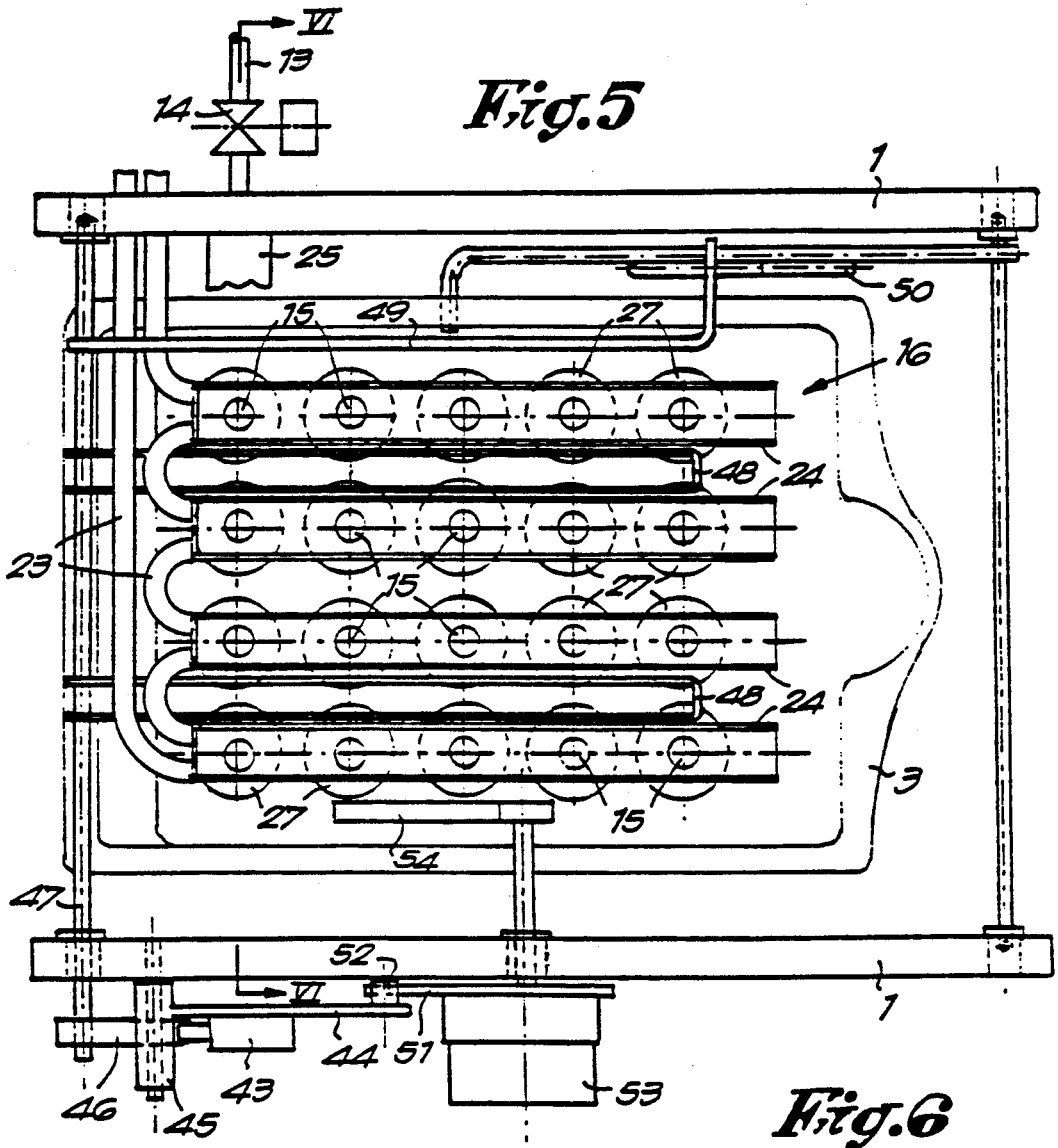
Figure 6:
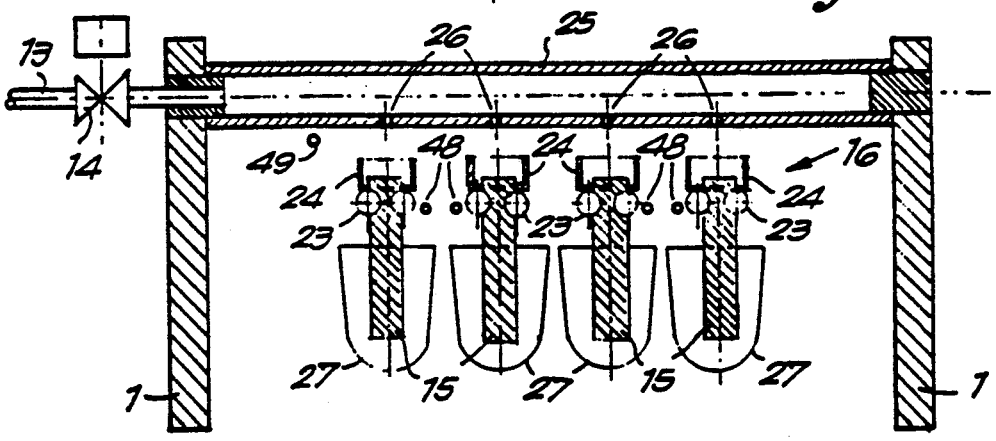
Figure 7:
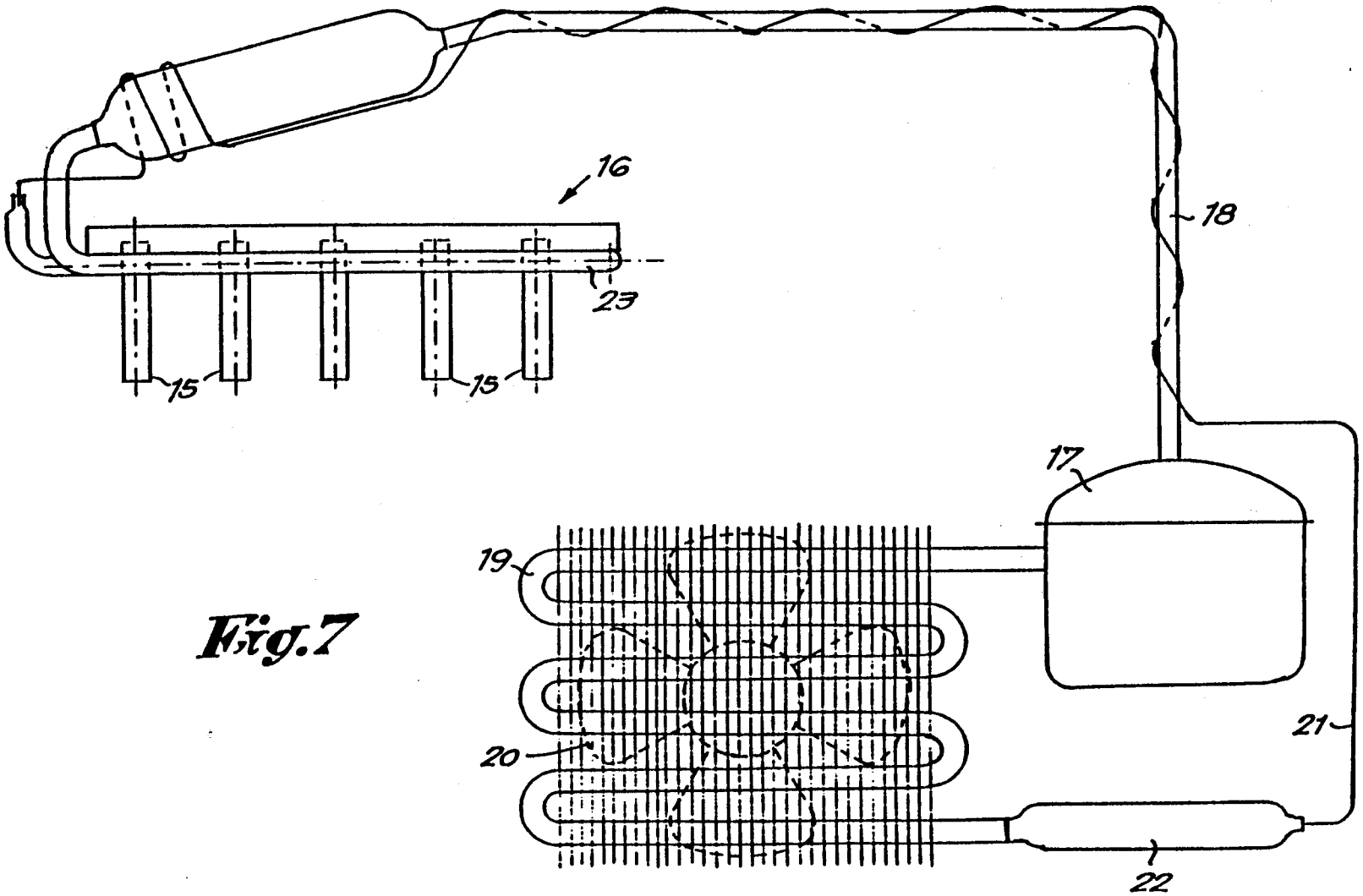
Figure 8:
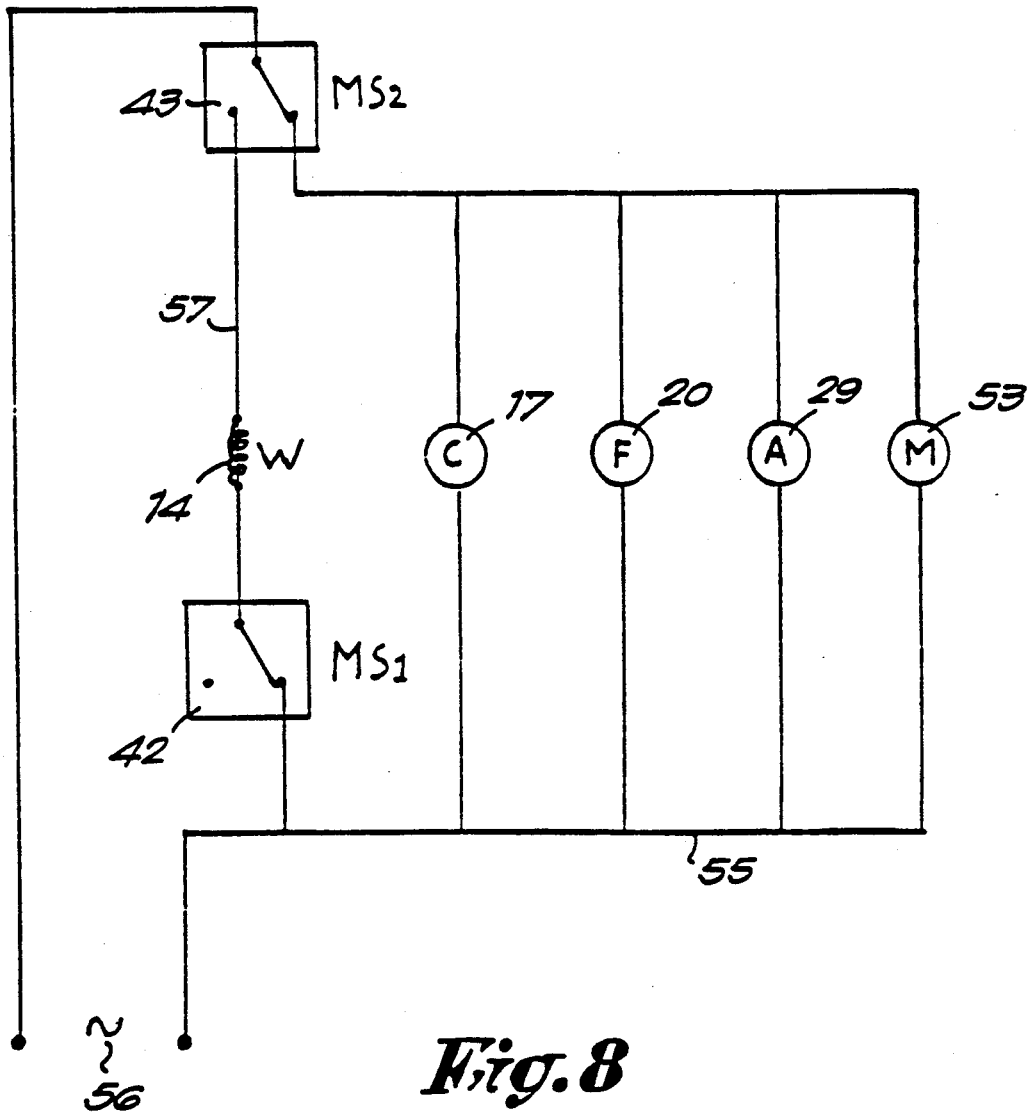

In order to better show the characteristics of the present invention, a preferred embodiment of a device for making ice cubes according to the invention is described hereafter, as example and without any restrictive character with reference to the enclosed drawings, in which:

FIG. 1 presents a side view with partial cut away of the uppermost part of the device for making ice cubes according to the invention, drawn in the initial position;

FIG. 2 presents a side view of the part of the device from FIG. 1 but after making ice cubes;

FIG. 3 presents a side view of the part from FIGS. 1 and 2 but during the defrosting and the falling off of the ice cubes;

FIG. 4 presents a side view of the part from FIGS. 1 through 3, with the water tank in the lowest position and all ice cubes fallen off;

FIG. 5 presents a top view of the part of the device for making ice cubes from the aforementioned figures;

FIG. 6 presents a cross-section of the evaporator and the feeler grid, taken along line VI—VI in FIG. 5;

FIG. 7 shows the refrigeration mechanism in a schematic manner;

FIG. 8 presents the electrical installation in a schematic manner; and

Figure 9:
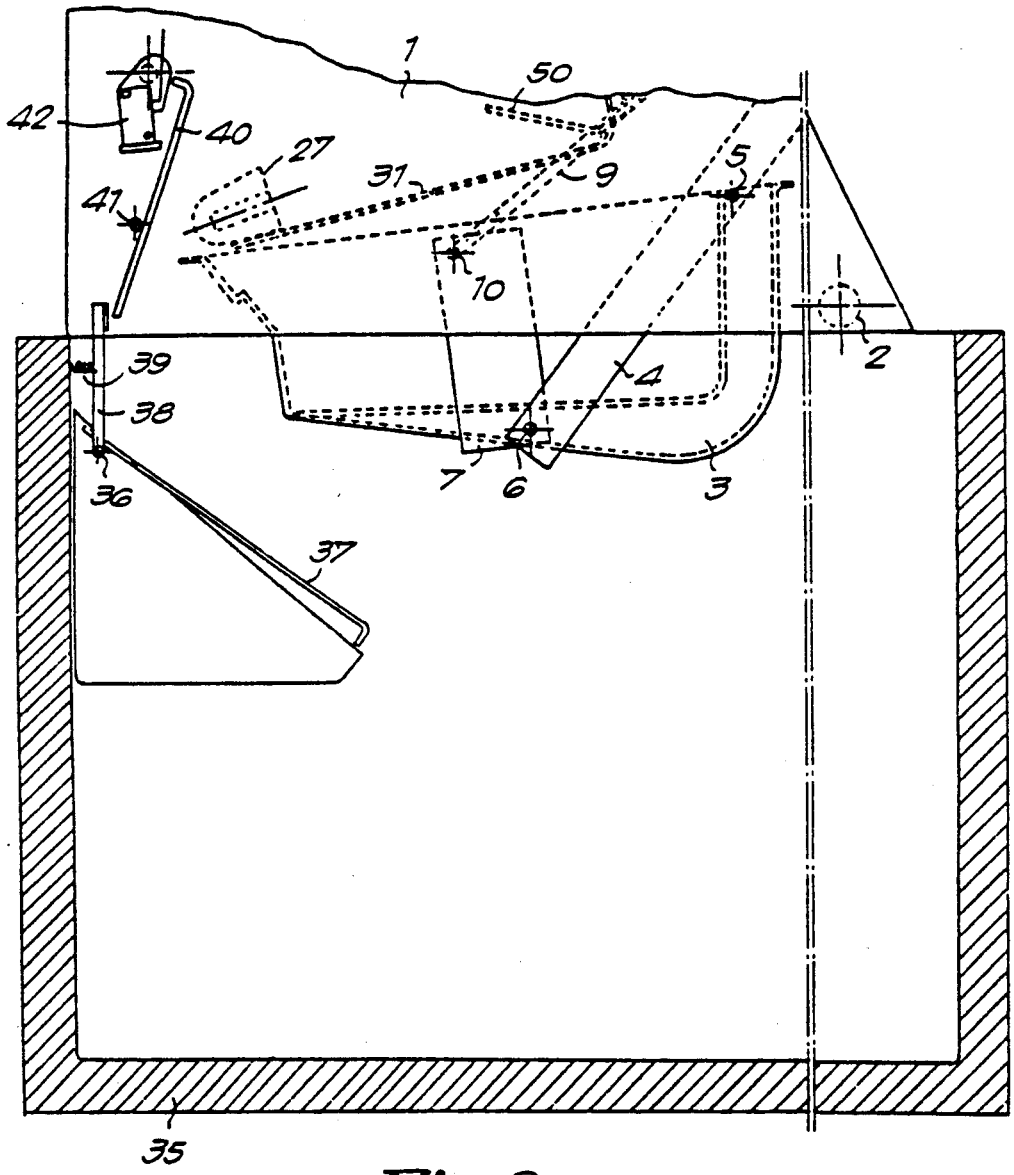

FIG. 9 presents a vertical cross-section of the lowest part of the device for the production of ice cubes from the aforegoing figures.

BEST MADE FOR CARRYING OUT THE INVENTION

The same reference numbers relate to the same elements in the various figures.

The device for forming ice cubes according to the figures contains a frame 1, 2 that principally consists of two upright walls 1 and transverse connections 2, 30 and 58 between which walls 1 a water tank 3 is movably mounted between an uppermost position presented in FIGS. 1 and 2 and a lowest position presented in FIGS. 3 and 4.

This water tank 3 is hingedly suspended from the frame 1, 2 by means of two arms 4 each of which is connected with a hinge point 5 hinged with an upright wall 1 of the frame 1, 2 and each of which is also hinged to a hinge point 6 with a small plate 7 fixed to a side wall of the water tank 3. The arms 4 extend past their hinge points 5 and a cylindrical counterweight 8 is fixed between their extremities. The movement of this arm 4 is restricted by two of the above mentioned transverse connections 2 which consequently at the same time determine the uppermost and lowest position of the water tank 3.

A directional arm 9 which, on the one hand, at a hinge point 10 near the uppermost edge of the tank 3 is connected with the above mentioned small plate 7 and, on the other hand, is attached to an axle 11 which is mounted on bearings in an upright wall 1 and also forms a hinge point for the arm 9, prevents the complete tipping over of the tank 3. The arms 4 and 9 form a right angle with their hinge points 5, 6, 10, and 11. This quadrangle is such that the water tank in its uppermost position forms another angle with the horizontal surface then in its lowest position. An opening 12 is cut away in an upright wall of the water tank 3. This opening 12 can be adjustable, so that the speed with which the water flows out of this opening may be predetermined. The difference between the angles that the water tank 3 in its uppermost and lowest position forms with the horizontal surface, is such that in the lowest position water can flow away out of the tank 3 through the opening 12 until this tank with its contents has become sufficiently light to move back upwards to its uppermost position under influence of the counter weight 8. In this uppermost position the opening 12 lies above the water level.

The downward movement of the water tank 3 is effected by the supplying of water into this tank in its uppermost position. The water supply is effected by means of a water supply pipe 13 which is fixed to the frame 1, 2 and exits above the water tank 3. An electric valve 14 is mounted in this water supply pipe.

In its uppermost position the water tank 3 is situated around a number of downwardly directed solid copper fingers 15 which have their extremities extend into the water in the tank. These fingers 15 are part of the evaporator 16 of the refrigeration mechanism.

This refrigeration mechanism contains at the same time a compressor 17 in a known manner which by means of a pipe 18 is connected to the outlet of the evaporator 16, a condenser 19 with a fan 20 coupled to it, which connects upstream of the compressor 17 and a capillary tube 21 which, on the one hand, connects to the outlet of the condenser 20 over a filter dryer 22 and, on the other hand, connects to the inlet of the evaporator 16. A refrigerating medium such as a hydrocarbon chlorofluoride compound flows through the aforementioned closed circuit.

The fingers 15 of the evaporator 16 are arranged in four rows. The fingers 15 of each row are placed with their uppermost extremities contained between a serpentine refrigeration pipe 23 of the evaporator 16. These parts of the pipe 23 are partly sunk into the fingers 15 in order to effect a maximum transfer of cold from the refrigeration medium that flows through the pipe 23 and these fingers 15. On top of the two parts of the pipe 23 which extend along a row of fingers, a duct 24 is attached. The uppermost extremities of the fingers 15 extend through the bottom of this duct 24. The evaporator 16 thus contains four ducts 22 which extend parallel to the side walls 1. The four ducts 24 are inclined slightly downwards towards one extremity. The other extremity of the ducts 24 is sealed and situated on the side of the exit of the water supply pipe 13. This water supply pipe 13 has, for that matter, a terminal piece 25 that extends between the two side walls 1, above the highest situated extremity of the ducts 24 and that is provided with an outlet opening 26 on the under side, opposite each duct 24. The fresh water that is supplied by the water supply pipe 13, does not therefore flow directly into the water tank 3 but in fact flows through the outlet openings 26 first into the ducts 24 which are in close contact with the fingers 15 and the refrigeration pipe 23. The water is therefore cooled before it flows over the open extremities of the ducts 24 into the water tank 3. As will further be explained, the warmth from the water supplied is also used to warm the evaporator after ice cubes 27 are formed around the fingers 15 to slightly or partially defrost these cubes, therefore causing them to fall off the fingers.

When the water tank 3 is in its uppermost position, an agitator 28 driven by a motor 29 which is only present in FIGS. 1 through 4 extends into a protruding part of this tank. The motor 29 of this agitator 28 is attached to a profile frame 58 which is attached between the walls 1. Clear ice cubes 27 are obtained through violent agitator 28.

On the bottom of the water tank 3, in its uppermost position, rests a removal grid 31. This removal grid 31 is folded around an upright side wall of the tank 3 and attached outside this tank 3 by means of an axle 32 hinged to the frame 1, 2. An arm 33 is attached to the folded part of the grid 31 which extends from the turned away side of the tank in relation to the axle 32. This arm 33 carries a counter weight 34 on its extremity to prevent the removal grid from exerting excessive pressure on the water tank 3. During the downward movement of the water tank 3 the removal grid 31 descends with it until it has reached an inclination of 15 to 20 degrees. In this position the grid remains hanging as presented in FIGS. 3 and 4. This happens because the arm 33 is retained by the transverse connection 30. The grid 31 remains hanging in this position, while the water tank 3 descends further. For the lowest position of the water tank 3 the removal grid 31 is completely free. The ice cubes 27 which fall off the fingers 15, are channelled into the storage tray 35 by this removal grid 31 on which, as presented in FIG. 9, the frame 1, 2 is mounted. As particularly appears from FIG. 9 the ice cubes 27 fall over and around a horizontal axle 36 hinged onto the top of the storage tray 35 and the diagonally downwardly extending feeler grid 37. The uppermost extremity of the feeler grid 37 is fixed to a lever 38 which by means of a spring 39 presented in the FIG. 9 is pulled into the position whereby also the feeler grid 37 therefore takes the position presented in this figure. When the storage tray 35 is full, the ice cubes 27 remain lying on the feeler grid 37. Through the weight of this, the lever 38 pushes against the spring 39. Through the intervention of a second lever 40 hinged around an axle 41 mounted on a wall 1, the position of an adjustable microswitch 42 mounted on this wall 1 is hereby altered.

This microswitch 42 is part of the control installation which contains a second microswitch 43 which is mounted on a swivel plate 44 which in turn is mounted on an axle 45 which rotates on a wall 1.

The two microswitches 42 and 43 are controlled by a cam 46 which is fixed to an upper grid 47, 48. As particularly appears from FIG. 5 this upper grid 47, 48 contains a horizontal transverse axle 47 which is mounted on bearings in the two walls 1, above the tank 3 in its uppermost position, and on there two elongated loops 48 formed of bent wire extend respectively between the outermost pair of rows of fingers 15, just under the refrigeration pipe 23, in the upward rotated position of the upper grid 47, 48. With the two loops 48 the upper grid 47, 48 is situated above the ice cubes 27 which are formed around the fingers 15, as clearly appears from FIGS. 2 and 3. By means of a lever 49 attached to the transverse axle 47 which rests with its extremity on the edge of the tank 3 when this tank is in the uppermost position, the upper grid 47, 48 is held in the above mentioned uppermost position. When the water tank 3 descends, the grid remains lying on the formed ice cubes and long enough so that only when all the ice cubes 27 have fallen off, the upper grid 47, 48 can rotate downwards to its lowest position, presented in FIG. 4 whereby the lever rests on a small bar 50 that is welded onto the above mentioned directional arm 9. The upper grid 47, 48 then still lies sufficiently high to allow the ice cubes 27 to slide unhindered from the removal grid 31.

With this downward rotation of the upper grid 47, 48 the cam 46 also rotates and this operates the microswitch 42 in a manner described as follows. The control of the microswitch 43 by the cam 46 occurs in the uppermost position of the upper grid 47, 48 and then particularly by the rotation of the swivel plate 44 on which this microswitch 43 is mounted. The swivelling of the swivel plate 44 is caused by a lever 51 which works together with a protrusion 52 on the swivel plate 44. The lever 51 is attached to a geared motor 53 which is freely suspended by its shaft on a side wall 1. Above the water tank 3 the shaft has a small bar 54 which is immersed in the water in the water tank 3 upon each rotation of the shaft as long as this tank is in its uppermost position. When the ice around the fingers 15 is sufficiently thick, the small bar 54 will be slowed down by this ice so that the geared motor 53 begins to rotate around its shaft. By means of the lever it then alters the position of the microswitch 43.

As appears from FIG. 8, in which the the electrical diagram is presented, the microswitch 42 is an ordinary switch while the microswitch 43 is a throw over switch. The compressor 17, the fan 20, the agitator motor 29 and the geared motor 53 are connected in parallel with each other in an electric circuit 54. This circuit 54 connects at one end directly to a pole of the alternating current supply 55. The other end of the circuit connects with the microswitch 43 to the other pole of the current supply 55. In one position of the microswitch 43 the circuit 54 is closed. In the other position of the microswitch 43 the circuit 54 is open. The microswitch 43 now connects one pole of the current supply 55 with a wire 56 to which the coil of the electric valve 14 is connected. This wire 56 is connected across the the microswitch 42 with the other pole of the current supply 55.

The operation of the device is now as follow:

The formation of ice cubes 27 commences when the water tank 3 is filled with water and is in its uppermost position as presented in FIG. 1. The upper grid 47, 48 is also in the uppermost position whereby it rests on the water tank 3 by means of the lever 49. The electric diagram is in the position presented in FIG. 8. The electric valve 14 is disconnected and by the positions of the microswitches 42 and 43 the compressor 17 and the fan 20. This is thus the refrigeration mechanism, and the motor 29 of the agitator 28 and the geared motor 53 are in operation. Through the evaporation of the refrigeration medium in the refrigeration pipe 23 the fingers 15 are cooled and ice is formed around these fingers.

When the ice is sufficiently thick, the small bar 54 experiences so much resistance from the ice that the geared motor 53 rotates in relation to the frame 1, 2 and rotates the swivel plate 44 with the assistance of the lever 51. Because of this the lever of the microswitch 43 slides off the cam 46 whereby the microswitch 43 is thus thrown over. The position of the device presented in FIG. 2 is obtained.

Through the throwing over of the microswitch 43 the refrigeration mechanism is disconnected and the motors 29 and 53 are also stopped. Since the microswitch 42 is in the position presented in FIG. 8, the coil of the electric valve 14 is now activated by the throwing over of the microswitch 43 which means that the water supply pipe is open and water flows over the ducts 24 into the water tank 3.

On the one hand, the evaporator is warmed by the warmth of the water supplied so that the ice cubes 27 defrost somewhat and fall off the fingers 15 and, on the other hand, the water tank 3 is filled until it becomes so heavy that it descends to its lowest position. In FIG. 3 the position is presented whereby the water tank 3 has already reached its lowest position but not all of the ice cubes 27 have fallen off yet. The upper grid 47, 48 is now no longer held back by the water tank 3 but it is conversely still held back by the cubes 27 which have remained hanging on the fingers 15.

Only when all cubes 27 have fallen off, can the upper grid 47, 48 rotate to its lowest position, presented in FIG. 4. As appears from this FIG. 4, the cam 46, which rotates with the upper grid 47, 48, furthermore pushes against the lever of the microswitch 42 which alters position in relation to the position presented in the FIG. 8. Through this the wire 57 is disconnected and the coil of the electric valve 14 is no longer activated. Through this the water supply shut off.

In the meantime water from the water tank 3, which is in its lowest position, is drained away through the opening 12. This opening 12 is so selected that at the start a large amount of water drains away but later, when the level has descended so far that the water tank almost goes back up, less water drains away out of the water tank and even less than can be supplied by the supply pipe with the electric valve 14 open.

Through the draining away of water out of the water tank 3 this tank now becomes light enough to move upwards again. During this upward movement the directional arm 9 also rotates and the upper grid 47, 48 is inclined back upwards by means of the small bar 50 welded on the directional arm 9 and the lever 49 connected to the grid. The cam 47 rotates back to its initial position through which the microswitch 42 is no longer held in its open position but returns to the position presented in FIG. 8. As long as the position of the microswitch 43 is not altered, the coil of the electric valve 14 is consequently activated again so that water flows back into the water tank 3. Through this the water tank 3 is topped up. When this water tank 3 has almost reached its uppermost position, lying namely approximately fifteen millimeters from its uppermost position, the cam 46 will change the position of the microswitch 43. The swivel plate 44 and the geared motor 53 have in the meantime returned to their initial positions presented in FIG. 1.

Through this change in the microswitch 43 the wire 57 is disconnected whereby the water valve 14 is therefore closed and the water supply is shut off. At the same time the compressor 17, the faN 20 and the motors 29 and 53 are again set into operation. The initial situation is again achieved as presented in the FIGS. 1 and 8, and the cycle described above can start again.

If during the upward movement of the water tank 3 an ice cube would still be on the removal grid 31, then with the upward rotation of this removal grid 31 with the tank 3, this ice cube 27 would be brought up along and could become stuck between the fingers 15. The water tank 3 would then not be able to reach its uppermost position. Because of this the microswitch 43 cannot be thrown over so that the electric valve 14 continues open and the water remains running. The water tank 3 consequently again descends so that the ice cube 27 still gets the opportunity to fall over the removal grid 31 into the storage tray.

Freezing solid of the evaporator 16 is completely excluded. As long as all ice cubes 27 have not fallen of the fingers 15, water continues to be supplied for the defrosting of the ice cubes. Furthermore the refrigeration mechanism is completely disconnected immediately after sufficient ice has been formed and the microswitch is therefore disconnected the first time.

Upon an initial commencement of operation of the machine, it is possible that the lever of the microswitch 43 is on the cam 46. The refrigeration cycle commences immediately but no ice can be formed since there is no water present yet in the water tank 3. It is sufficient then to pull the water tank 3 down by hand until the cooling stops and water begins to flow. The water tank 3 must be held in this position until it descends by its own weight. A short time after descent the tank will return upwards and the device can continue normal operation.

If when starting a new device the lever of the microswitch 43 is next to the cam 46, water will immediately flow into the water tank when starting. The water tank 3 will descend to its lowest position and, since there are no ice cubes on which the upper grid 47, 48 can remain hanging, the microswitch 42 will be opened rather quickly through which the water supply stops and shortly afterwards the water tank returns upwards after which normal operation can commence.

The microswitch 42 is not only controlled by the cam 46 but, as already stated, also by the lever 40 when the storage tray 35 is full. When ice cubes 27, which slide from the grid 31 presented in FIG. 3, remain on the feeler grid 37, the microswitch 42 is pushed into an open position by the intervention of the lever 40. Because of this, activation of the electric valve 14 stops immediately and the water supply stops. The water tank 3 that is in its lowest position, will move upwards again rather quickly. If in the meantime all the ice cubes 27 have not yet fallen off, then the swivel plate 44 and the cam 46 remain in the position presented in FIG. 3 and the refrigeration mechanism remains out of operation. If on the other hand all ice cubes 27 have already fallen off and the upper grid 47, 48 is still in its lowest position, the position of the microswitch 43 will be altered upon the upward movement of the water tank 3. The refrigeration mechanism will be connected but, as soon as sufficient ice is formed, the refrigeration mechanism will simply be disconnected. The tank 3 will not be moved downwards since no water can be supplied. In both cases therefore the formation of ice is stopped.

The device described above is of simple construction and safe in use. The defrosting for causing the ice cubes 27 to fall off the fingers is prolonged until it is certain that all ice cubes 27 have fallen off. The certainty that all ice cubes 27 have fallen off, is achieved in a mechanical manner by the upper grid 47, 48. The complete device only contains two microswitches through which the device is very simple and the chance of defects is reduced to a minimum. The adjustment of the microswitches is very simple and requires little time.

The present invention is in no way restricted to the embodiments described above as examples and shown in the drawings, but such device for making ice cubes may be developed in different forms and dimensions without departing from the scope of the present invention.

I claim:

1. Process for making ice cubes, comprising:

moving a tank with water into an uppermost position around downwardly directed protruding parts, refrigerating the protruding parts when the tank is in said uppermost position so that ice is formed around said protruding parts, moving said tank from its uppermost position to a lowermost position by supplying water to said tank, after a predetermined amount of ice has been formed around said protruding parts and, partially defrosting the ice formed around said protruding parts so that said ice falls off after the predetermined amount of ice has been formed around said protruding parts, wherein an upper grid hingedly mounted around a horizontal axis is pushed up, by the movement of the tank from said lowermost position to said uppermost position into an uppermost position in which position it is located between the protruding parts so that, when ice is formed around said parts the grid is situated above the ice cubes and cannot go downward as long as all the ice cubes have not yet fallen off, and wherein the defrosting is only stopped and subsequently the refrigerating of the protruding parts restarted after said grid has hinged downwards from its uppermost position, and thus after all the ice cubes have fallen off.

2. The process of claim 1, which comprises using the water supplied for moving the tank from the uppermost position to its lowermost position at the same time for partially defrosting the ice formed around said protruding parts.

3. The process according to claims 1 or 2, which utilizes a motor for driving an axle provided with a protrusion, and a switch wherein when the moment of the ice the predetermined amount of is detected by means of the motor driving the axle provided with the protrusion, the protrusion moves at least partly in the tank when the tank occupies its uppermost position, the motor turning in relation to the frame when the protrusion experiences resistance from the ice formed in the tank, and refrigerating of the protruding parts is stopped by a change of position of the switch caused by turning of the motor.

4. The process according to claim 2, which comprises stopping the refrigeration and also starting the partial defrosting water supply when the predetermined amount of ice has been formed, said water supply causing the water tank to move to its lowermost position, wherein the water supply is stopped when, after all the ice has fallen off, the upper grid moves to its lowermost position, and the water supply is again started when the grid moves again to its uppermost position together with the water tank but shortly thereafter being stopped when the water tank reaches its uppermost position, and wherein the refrigeration is started again when said tank reaches said uppermost position.

5. Device for making ice cubes, which comprises:

a frame;

a refrigeration mechanism which has a compressor, a condenser, an expansion element and an evaporator with downwardly directed protruding parts mounted on said frame, means for partially defrosting ice formed around the protruding parts and for causing the ice to fall off, a water tank movably mounted on the frame;

a water supply pipe located above the tank, means for moving the tank from an uppermost position around the protruding parts to a lowermost position and vice versa, said means for moving the tank including means for opening and closing the water supply pipe, and means for controlling the refrigeration mechanism and the means for moving the tank, which includes an upper grid hingedly mounted around a horizontal axis to the frame and which extends from the uppermost position of the tank on the top to a position between the downwardly directed protruding parts of the evaporator so that, when the ice cubes have been formed around the protruding parts, the upper grid is situated above the ice cubes and cannot descend as long as all ice cubes have not fallen off, wherein the means for controlling the refrigeration mechanism and the means for moving the tank have at least one switch which is controlled by the upper grid.

6. Device according to claim 5, wherein the means for partially defrosting the ice formed about the protruding parts includes means for opening and closing the water supply pipe.

7. Device according to claims 5 or 6, which comprises means for detecting ice formation, with includes an axle mounted on bearings in the frame, a motor for driving the axle, said motor being loose from the frame and at least one protrusion fixed to the axle and, with the rotation of the axle, moves at least partly in the tank when said tank occupies its uppermost position, and wherein the means for controlling the refrigeration mechanism includes a switch which is controlled by the motor means for detecting ice formation.

8. Device according to claim 7, which comprises a swivel plate for cooperating with the motor wherein the switch which is controlled by the motor is mounted on said swivel plate.

9. Device according to claim 5, which comprises a cam which is fixed to the upper grid so as to control the means for controlling the refrigeration mechanism.

10. Device according to claim 8, which comprises a supply of liquid for defrosting wherein the evaporator has a refrigeration pipe and includes a number of downwardly directed fingers of which the uppermost extremities, on the one hand, are contained between two parts of the refrigeration pipe and, on the other hand, are situated above the two parts in the supply of liquid for defrosting.

11. Device according to claim 5, which comprises a supply of liquid for defrosting wherein the evaporator has a refrigeration pipe and includes a number of downwardly directed fingers of which the uppermost extremities, on the one hand, are contained between two parts of the refrigeration pipe of the evaporator and, on the other hand, are situated above the two parts in the supply of liquid for defrosting.

12. Device according to claim 11, wherein the means for partially defrosting ice formed about the protruding parts includes means for opening and closing the water supply pipe.

13. Device according to claim 5, which comprises an agitator which is mounted on the frame and, in the uppermost position of the water tank sticks in the tank.

14. Device according to claim 5, which comprises a storage tray for ice cubes which is situated under the water tank, and a feeler grid which is mounted on top of the storage tray, wherein the means for controlling the refrigeration mechanism and the means for moving the tank contain a switch which is controlled by the feeler grid to disconnect at least the means for moving the tank when a predetermined amount of ice is present in the storage tray.

* * * * *